US006764533B2

(12) United States Patent
Lobiondo, Jr.

(10) Patent No.: US 6,764,533 B2
(45) Date of Patent: Jul. 20, 2004

(54) ELECTRONIC AIR FILTER ASSEMBLY

(75) Inventor: Joseph A. Lobiondo, Jr., Penrose, CO (US)

(73) Assignee: Joseph A. Liobiondo, Sr., Lewes, DE (US)

( * ) Notice: Subject to any disclaimer, the term of this patent is extended or adjusted under 35 U.S.C. 154(b) by 0 days.

(21) Appl. No.: 10/282,093

(22) Filed: Oct. 29, 2002

(65) Prior Publication Data

US 2003/0079609 A1 May 1, 2003

Related U.S. Application Data

(60) Provisional application No. 60/330,740, filed on Oct. 30, 2001.

(51) Int. Cl.[7] ..... B03C 3/155

(52) U.S. Cl. ..... 96/66; 55/493; 55/DIG. 31; 96/94

(58) Field of Search ..... 96/66, 94; 55/493, 55/497, 499, DIG. 31

(56) References Cited

U.S. PATENT DOCUMENTS

| | | | | | |
|---|---|---|---|---|---|
| 3,252,580 | A | * | 5/1966 | Getzin | 210/485 |
| 3,280,984 | A | * | 10/1966 | Sexton et al. | 210/485 |
| 3,912,473 | A | * | 10/1975 | Wilkins | 55/501 |
| 4,549,887 | A | | 10/1985 | Joannou | |
| 4,828,586 | A | | 5/1989 | Joannou | |
| 4,886,526 | A | | 12/1989 | Joannou | |
| 4,978,372 | A | | 12/1990 | Pick | |
| 5,059,218 | A | | 10/1991 | Pick | |
| 5,108,470 | A | | 4/1992 | Pick | |
| 5,143,604 | A | * | 9/1992 | Bernard et al. | 210/168 |
| 5,330,722 | A | | 7/1994 | Pick et al. | |
| 5,462,665 | A | * | 10/1995 | Green | 210/496 |
| 5,525,145 | A | * | 6/1996 | Hodge | 96/17 |
| 5,538,692 | A | | 7/1996 | Joannou | |
| 5,571,300 | A | * | 11/1996 | Stemmer | 55/493 |
| 5,573,577 | A | | 11/1996 | Joannou | |
| 5,766,285 | A | * | 6/1998 | Killman | 55/385.6 |
| 5,776,218 | A | * | 7/1998 | Enns | 55/495 |
| 5,807,425 | A | | 9/1998 | Gibbs | |
| 5,846,302 | A | | 12/1998 | Putro | |
| 5,846,603 | A | * | 12/1998 | Miller | 427/244 |
| 6,077,334 | A | | 6/2000 | Joannou | |
| 6,136,058 | A | * | 10/2000 | Miller | 55/524 |
| 6,237,970 | B1 | | 5/2001 | Joannou | |
| 6,425,945 | B1 | * | 7/2002 | Cheng | 96/66 |

FOREIGN PATENT DOCUMENTS

| | | |
|---|---|---|
| GB | 2 294 890 B | 3/1997 |

OTHER PUBLICATIONS

ESSA; Installation and Maintenance Instructions For The ESSA Polarized Media Panel Filter; ESSA Corporation, p1–2, Canada; Undated.

Netco Air Products; What You Breathe Today. . . Is How You'll Look and Feel Tomorrow; p1–2 ; Lewes, Delaware 19958, Undated.

Superior Fibers, Inc.; Superior Media For Air Filtration And Paint Over spray Collection; pp1–6; Bremen, Ohio 43107, Undated.

* cited by examiner

*Primary Examiner*—Richard L. Chiesa
(74) *Attorney, Agent, or Firm*—Rothwell, Figg, Ernst & Manbeck, P.C.

(57) ABSTRACT

An electronic air filter assembly includes filter media disposed on opposite sides of an electrified charging screen. The filter media and charging screen are held between outer screens. The outer screens are held together in an assembled condition by pressure-sensitive securements and can be pulled apart to disassemble the filter assembly by applying an outer screen-separating force sufficient to overcome the holding force of the securements.

12 Claims, 3 Drawing Sheets

ELECTRONIC AIR FILTER ASSEMBLY

This application claims the benefit of U.S. Provisional Application No. 60/330,740 filed Oct. 30, 2001.

BACKGROUND OF THE INVENTION

Electrostatic filters have been developed for incorporation into heating ventilation and air conditioning (HVAC) systems. Such filters, having the same general overall dimensions as a conventional panel-type filter element, can be placed into the duct of an HVAC system and oriented transverse to the direction of air flow in the duct. In general, electrostatic filters include a central charging screen that is sandwiched between two fibrous filter elements, and the filter elements and charging screen are enclosed between outer screens, each having a rigid frame surrounding a mesh material. Power is applied to the central charging screen which induces a particle-attracting charge in the filter elements, thereby providing improved filtration as compared to a non-electrified filter. Examples of such filter assemblies are described in the following United States patents, the respective disclosures of which are hereby incorporated by reference: U.S. Pat. Nos. 5,846,302; 5,807,425; 5,573,577; 4,828,586; 4,549,887; 4,886,526; 4,978,372; and 5,108,470.

Prior art electronic filters include clumsy latches or other hardware for holding the multi-piece filter assembly together. Such hardware protrudes from the frames of the outer screens and can get hung up on screws or rivets securing c-channels for holding the filter assembly within the duct of the HVAC system, thereby making the installation and extraction of the filter assembly difficult.

Accordingly, there exists a need for an electronic air filter assembly in which the filter assembly is securely held together in a manner which does not interfere with the duct work in which the filter is installed and in a manner which permits easy disassembly.

SUMMARY OF THE INVENTION

The present invention includes a multi-piece electronic filter assembly whereby the pieces are held together by pressure-activated securements that do not protrude or otherwise extend outside of the outer frames of the assembly. Accordingly, there are no structures or latches to get caught when the filter is installed in or removed from a duct. Moreover, the filter assembly can be disassembled by pulling the outermost pieces of the assembly apart with sufficient force to overcome the securements.

In another aspect of the invention, the overall particle attraction of the assembly is improved by the use of tackified filters.

Other objects, features, and characteristics of the present invention, including the methods of operation and the function and interrelation of the elements of structure, will become more apparent upon consideration of the following description and the appended claims, with reference to the accompanying drawings, all of which form a part of this disclosure, wherein like reference numerals designate corresponding parts in the various figures.

DETAILED DESCRIPTION OF THE PREFERRED EMBODIMENT

Figure 1:
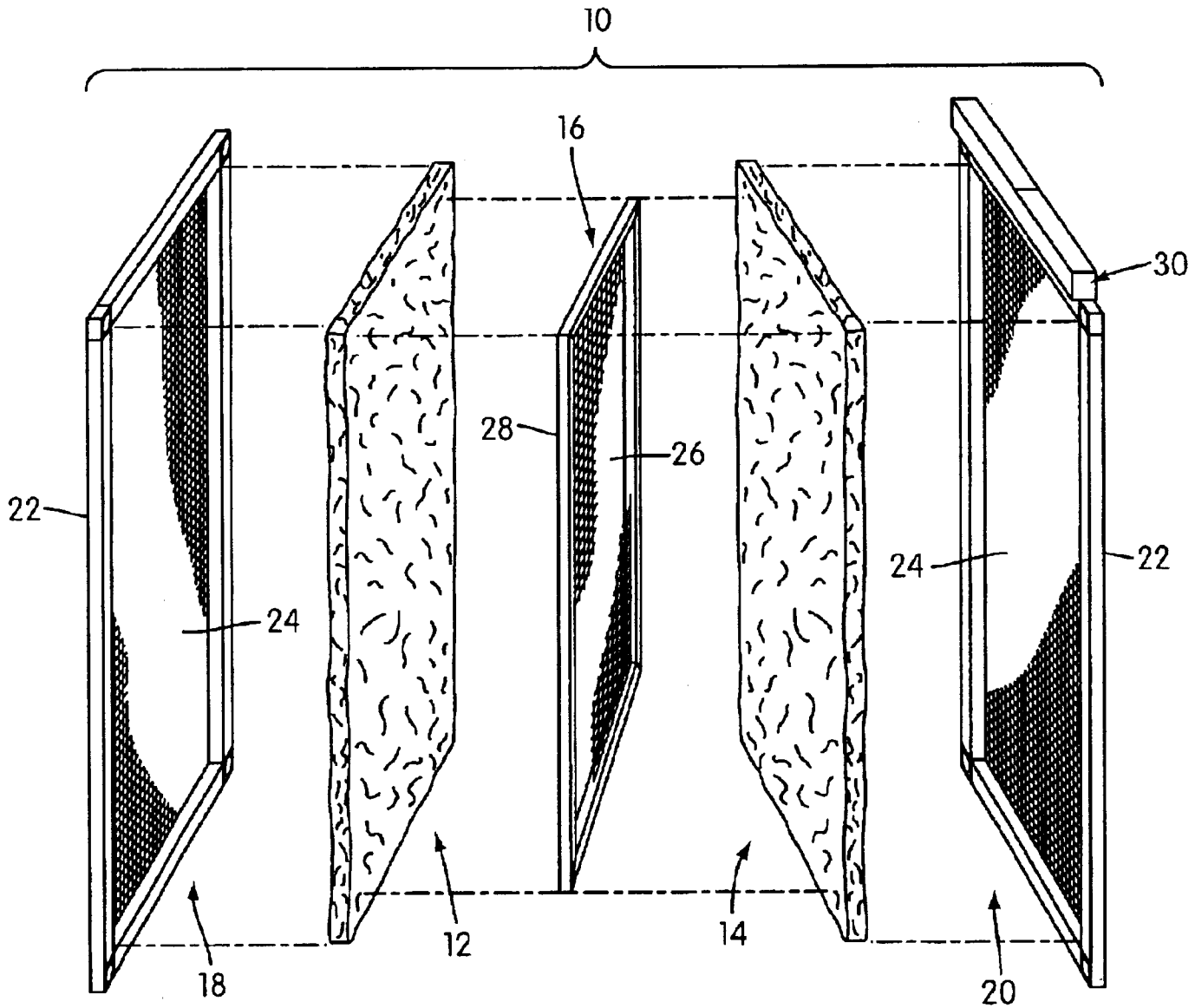
FIG. 1 is an exploded view of the elements which make up the air filter assembly.

An embodiment of the electrostatic air filter assembly 10 is illustrated in FIG. 1. The assembly 10 comprises filter media preferably in the form of two filter elements 12, 14 formed from sheets of filter material for gas, preferably formed of battings of a tackified glass fiber material and being of the same rectangular shape and size. Most preferably, the filter elements are battings of unwoven long strand fiberglass web with a tackifier uniformly distributed on the glass fibers as described in U.S. Pat. Nos. 6,136,058 and 5,846,603, the disclosures of which are hereby incorporated by reference. Such tackified fiberglass filter material is available from Superior Fibers, Inc. The fiberglass batting of the filter elements 12, 14 are preferably 13 gram/ft$^2$ fiberglass web. Conventional electronic filter assemblies employ 16 gram/ft$^2$, non-tackified fiberglass filter elements. The use of tackified filter material improves the efficiency of the filter assembly. The 13 gram/ft$^2$ filter elements of the present invention result in a smaller pressure drop across the filter assembly as compared to the pressure drop across filter assemblies employing 16 gram/ft$^2$ filter elements. In addition, the use of tackified filter elements ensures that the filter assembly of the present invention will be at least as effective as conventional filter assemblies employing more dense, but non-tackified filter elements.

A charging element, preferably in the form of a charging screen 16, is sandwiched between elements 12, 14, and comprises a rectangular frame 28, preferably of extruded elongated members formed from rigid, nonconductive material onto which a rectangular mesh (preferably a metal wire mesh) 26 is disposed. The frame 28 is preferably made from rigid PVC. The mesh 26 of the charging screen 16 is preferably an 8×8 (i.e., eight openings per inch in either direction) mesh of 11 gauge bright aluminum wire. The charging screen 16 can have another structure, instead of the mesh 26, such as a metal gauze or perforated metal sheet or a grill of wires or a punched metal lattice, but the mesh, grill, lattice, etc. should be made of an electrically conductive material and be of a construction that readily allows air flow therethrough.

When the filter assembly is in the assembled condition, the charging screen 16 and filter elements 12, 14 are held together by outer retaining elements, preferably in the form of outer screens 18, 20. The first outer screen 18 comprises a rectangular frame 22, preferably formed from four rectangular aluminum extrusions 34 interconnected, for example, by plastic 90° connectors 36. A rectangular wire mesh 24 is located within frame 22. The mesh 24 is preferably an 8×8 mesh of epoxy-covered 11-gauge aluminum wire. The epoxy covering gives the mesh some resiliency, thereby making the stretched mesh 24 less susceptible to denting. The second outer screen 20 is substantially the same as the first outer screen 18 and also comprises a rectangular frame 22 formed of extruded aluminum pieces 34 interconnected by plastic 90° connectors 36 and has a wire mesh 24 extending between the sides thereof and located in the same manner.

The two outer screens 18, 20 are of the same size and shape as each other. The wire mesh 24 is preferably secured to the outer surface of the frames 22 of the screens 18, 20. Thus, when the screens 18, 20 are brought together, a space is defined between the respective meshes 24 of the screens 18, 20 that is approximately twice the thickness of each frame 22. The filter elements 12, 14 are of the same size and shape as each other, but slightly smaller than frames 22 so as to be clampable therebetween with the edges of the filter material preferably abutting or even slightly overlapping the inner peripheral edges of the frames 22 so as to ensure that air passing through the wire meshes 24 also passes through the filter elements. The frame 28 of the charging screen 16 is smaller than the inner periphery defined by the frames 22.

Figure 2:
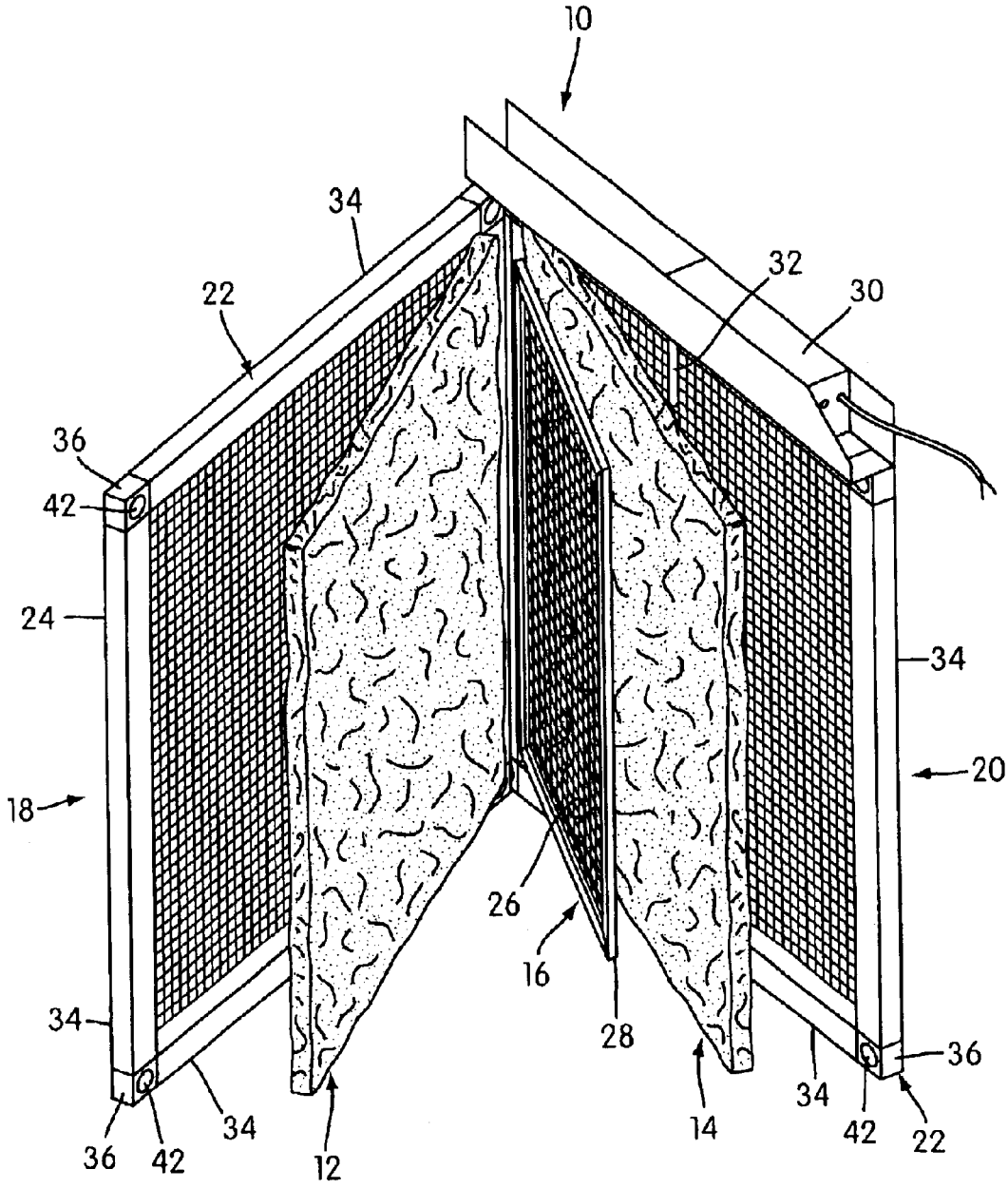
FIG. 2 shows the arrangement of the air filter assembly elements when the assembly is in the open position.

As shown in FIG. 2, the outer screens 18 and 20 are preferably hinged at one edge such that filter elements 12, 14 and the charging screen 16 can be clamped between them. Pressure-activated securements 42 are mounted to the edges of the frames 22 opposite the hinges, preferably in the corners. The securements 42 are mounted on corresponding facing surfaces in co-aligned positions such that they engage each other when the hinged outer screens 18, 20 are closed. The securements 42 are constructed and arranged to interlock with one another when pressed together and to release each other when pulled apart with sufficient force.

Figure 3:
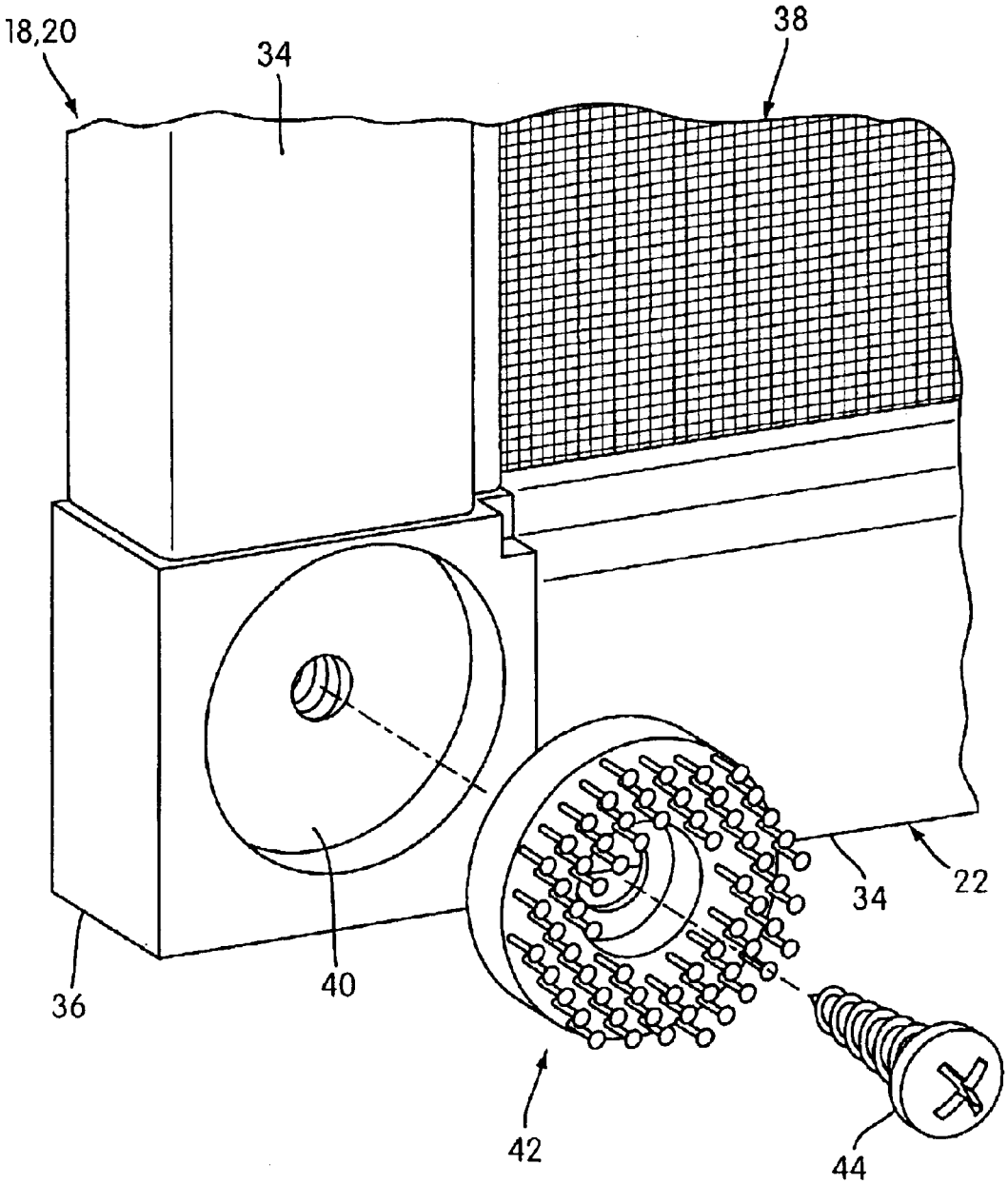
FIG. 3 is a partial, exploded view showing attachment of a securement to an outer screen of the filter assembly.

As shown in FIG. 3, the securement 42 comprises a circular plastic plug of upstanding fingers with enlarged heads. Self-lock, mushroom head fasteners, having a density of 400-heads per square inch and a 9/16 inch diameter, manufactured by 3M and known as a dual lock washer are preferred for the securements. The mushroom heads of the fingers interlock with the enlarged heads of the upstanding fingers of a mating securement plug on the corresponding surface of the opposite screen frame. The plug is installed into a similarly sized circular recess 40 formed in the corner piece 36 and is fastened there by means of a screw 44. The plug may be of some other shape, but circular is preferred because of the relative ease of forming a circular recess to receive the plug, as opposed to a recess of some other shape. Securements are preferably installed in the two corners opposite the hinged edges of the screens 18, 20. In an alternate, though less preferred embodiment, securements 42 can be installed in all four corners of the screens 18, 20, and the hinges can be omitted.

An electrode 32 in FIG. 2 is arranged such that the filter element 14 will fit between the electrode 32 and wire mesh 24. Thus, when screens 18, 20 are closed, electrode 32, preferably a wire with an exposed end, makes physical and electrical contact with the charging screen 16.

A high voltage power supply 30, an example of which is detailed in U.S. Pat. No. 5,846,302, hereby incorporated by reference, is attached to one edge of one of the screens 18, 20. When the high voltage power supply 30 is connected to a source of electricity, e.g., a 24-volt power line, voltage is supplied, via the electrode 32, to the charging screen 16. The charging screen 16 is in contact with the nonconductive filter elements 12, 14 and induces a particle-attracting charge in the filter elements 12, 14. The epoxy covering of the mesh 24 of outer screens 18, 20 acts as an electrical insulator, which reduces the incidence of arcing between the mesh 26 of the charging screen 16 and the mesh 24 of the outer screens 18, 20, which are grounded when the filter assembly 10 is installed.

While the invention has been described in connection with what are presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

Furthermore, those of the appended claims which do not include language in the "means for performing a specified function" format permitted under 35 U.S.C. §112(¶6), are not intended to be interpreted under 35 U.S.C. §112(¶6) as being limited to the structure, material, or acts described in the present specification and their equivalents.

What is claimed is:

1. A filter assembly comprising:

a charging element;

a power supply electrically connected to said charging element when said filter assembly is in an assembled condition;

filter media in contact with said charging element;

outer retaining elements encasing said charging element and said filter media when said filter assembly is in the assembled condition; and securements disposed on corresponding portions of each of said outer retaining elements, said securements being constructed and arranged to lockingly engage each other when said outer retaining elements are positioned together with said corresponding portions mutually engaged with each other and to disengage from one another upon manual application of a pulling force separating said corresponding portions, wherein at least one of said securements comprises a plug having a plurality of fingers upstanding from a base thereof with enlarged heads disposed at distal ends of said fingers.

2. The filter assembly of claim 1, wherein said filter media comprises tackified glass fibers.

3. The filter assembly of claim 1, wherein said charging element comprises a screen having a rigid frame with a metal mesh carried thereon.

4. The filter assembly of claim 3, wherein said filter media comprises battings of glass fibers disposed on opposite sides of said charging element.

5. The filter assembly of claim 4, wherein said outer retaining elements comprise screens, each having a rigid frame with a mesh carried thereon.

6. The filter assembly of claim 5, further comprising hinges connecting corresponding edges of said outer retaining element screens.

7. A filter assembly comprising:

a charging element;

a power supply electrically connected to said charging element when said filter assembly is in an assembled condition;

filter media in contact with said charging element;

outer retaining elements encasing said charging element and said filter media when said filter assembly is in the assembled condition, each said retaining element comprising a generally rectangular frame with a mesh carried thereon, said frames being arranged in co-aligned, mutually facing positions when said filter assembly is in the assembled condition; and securements disposed on corresponding facing portions of said frames of said outer retaining elements, said securements being constructed and arranged to lockingly engage each other when said outer retaining elements are positioned together with said corresponding facing portions mutually engaged with each other and to disengage from one another upon manual application of a pulling force separating said corresponding portions, said securements being disposed entirely between said facing portions of said frames when said corresponding facing portions are engaged with each other such that no portions of said securements protrude outwardly of said frames.

8. The filter assembly of claim 7, wherein said filter media comprises tackified glass fibers.

9. The filter assembly of claim 7, wherein said charging element comprises a screen having a rigid frame with a metal mesh carried thereon.

10. The filter assembly of claim 7, wherein said filter media comprises battings of glass fibers disposed on opposite sides of said charging element.

11. The filter assembly of claim 7, further comprising hinges connecting corresponding edges of said outer retaining element frames.

12. The filter assembly of claim 7, wherein at least one of said securements comprises a plug having a plurality of fingers upstanding from a base thereof with enlarged heads disposed at distal ends of said fingers.

* * * * *